United States Patent [19]

Mundell et al.

[11] 4,337,931

[45] Jul. 6, 1982

[54] SPRING BASE FOR UPHOLSTERED SEATING

[75] Inventors: Donald D. Mundell, Carthage; John P. Gowing, Joplin, both of Mo.

[73] Assignee: Flex-O-Lators, Inc., Carthage, Mo.

[21] Appl. No.: 180,593

[22] Filed: Aug. 25, 1980

[51] Int. Cl.[3] ..... F16F 3/02; A47C 7/02

[52] U.S. Cl. ..... 267/102; 267/112; 297/459; 297/452

[58] Field of Search ..... 267/86, 90, 102, 110, 267/111, 112, 142; 297/458, 459, 460, 452

[56] References Cited

U.S. PATENT DOCUMENTS

| | | | |
|---|---|---|---|
| 3,195,955 | 7/1965 | Richardson et al. | 267/112 X |
| 3,639,002 | 2/1972 | Tischler | 297/452 |
| 3,762,770 | 10/1973 | Tedesco et al. | 297/458 X |
| 3,797,886 | 3/1974 | Griffiths | 297/458 X |
| 3,880,467 | 4/1975 | Tischler | 297/458 X |
| 4,003,564 | 1/1977 | Taylor | 267/112 X |
| 4,172,589 | 10/1979 | Griffths | 267/110 |
| 4,191,424 | 3/1980 | Mundell | 297/459 |

*Primary Examiner*—George E. A. Halvosa

*Attorney, Agent, or Firm*—John A. Hamilton

[57] ABSTRACT

A spring base for upholstered seating, particularly automotive seats having upwardly and outwardly inclined "wings" or bolsters at the sides thereof, consisting of a pair of spaced apart side bolster wires each adapted to be supported by spaced helical springs attached thereto and extending outwardly therefrom for connection at their outer ends to a fixed frame, and a series of relatively closely spaced spring cross wires extending between the bolster wires and connected thereto, certain of the cross wires being of relatively small gauge and extending only between the bolster wires, and certain of the cross wires being relatively heavy gauge and extending beyond the bolster wires and being angled upwardly and outwardly to provide spring support for the bolsters, all with the purpose of providing the necessary spring strength in the various areas of the seat, as well as the necessary closeness of the wires to provide adequate support for the helical springs and adequate support for the cushioning material applied thereover, with a minimum of wire weight, and hence the greatest possible economy of cost.

10 Claims, 9 Drawing Figures

SPRING BASE FOR UPHOLSTERED SEATING

Figure 1:
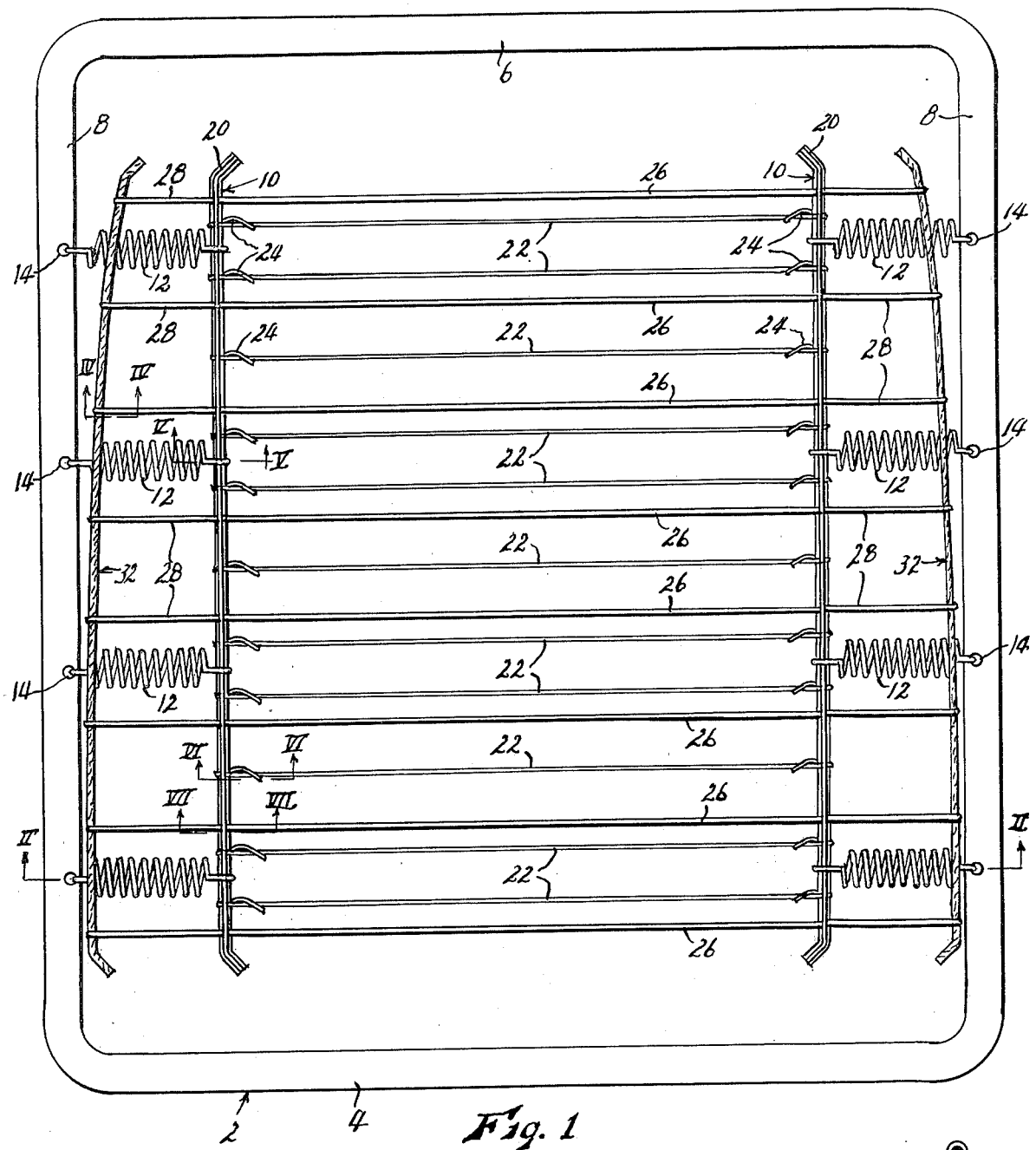

This invention relates to new and useful improvements in spring bases for upholstered seating, and has particular reference to automotive seating of the type commonly known as "bucket seats", in which a generally level main seating area is provided with upwardly and outwardly inclined side edge portions, commonly known as "bolsters". The concept is also applicable to seat backs, as well as to the seat "bottoms" above referred to. The provision of an efficient but still economical spring base for a seat of this type, which will provide both adequate resilience for both the main and bolster seat areas, and also a sufficiently continuous platform for supporting the padding layers applied over both areas of the seat, all with the use of the smallest possible amount and weight of spring wire, has been a persistent problem in the industry. Weight and cost reductions are of course both extremely important considerations in the automotive industry.

The spring base for this type of seating in perhaps the most common present usage comprises a pair of spring bolster wires extending forwardly and rearwardly along the sides of the main seating area, each adapted to be supported from a frame by helical springs spaced therealong and extending transversely outwardly therefrom for connection to the frame, and a series of closely spaced spring cross wires extending transversely between and connected to said bolster wires, the cross wires extending outwardly from the bolster wires in upwardly inclined relation to the main seating area to provide spring support for the bolster areas. Padding material is of course applied over both the main and bolster areas. The redesigning of the wire atructure as to the gauge, number and disposition of the wires required, to the end that the wire weight and hence the costs of production can be reduced, without sacrificing their efficiency of operation, is the primary object of the present invention.

Experience has shown that the bolster wires should be of about 12 gauge oil-tempered spring steel, it having been found that this is sufficient to support them against the substantial beam loading applied thereto by the helical support springs, provided that the cross wires are spaced apart no more than about one inch, while still permitting the support surface to conform to the shape of the body load applied thereto in use for the best comfort characteristics. Redesign of the base therefore cannot logically relate to changes in these wires, and the present invention therefore relates primarily to changes in the size and disposition of the cross wires. In the past, a minimum of about 17 gauge spring steel wire, spaced at no more than about one inch apart, has been considered necessary in view of all the requirements made thereon. The one-inch or less apacing thereof, in the main seating area, is necessary if they are to provide a sufficiently continuous support for the padding applied thereover, the unit loading in this area being relatively high. They could be more widely spaced in the bolster areas from this viewpoint, since the unit loading in these areas is much lower, but then they would not have the resilient strength necessary to support the bolster areas sufficiently, the wire end portions supporting these areas being subject to contilever loading. Also, the cross wires in the main seating area could be of smaller gauge, since these portions of the wires, being connected at their ends to the bolster wires, are loaded principally only in tension, in which they are very strong, but their extended end portions which support the bolster areas would not have sufficient strength to withstand the cantilever loading thereof. It has been determined by experimentation that heavier wire, say 16 gauge, will supply both the necessary cantilever strength and also adequate padding support in the bolster areas even when spaced two inches apart, but their use in the main seating area would be wasteful in wire weight and cost where the heavier wire is not necessary, and the wider spacing would deprive the padding in this area of the required continuity of support.

Therefore, a more specific object of the present invention is the provision of a spring base wherein most of the cross wires are of a reduced size, say 18 gauge, spaced on one inch centers to provide the necessary continuity of padding support, and to provide adequately short spans of the bolster wires therebetween to support said bolster wires against the beam loading applied thereto by the helical springs, and are affixed at their ends to the bolster wires, and wherein the remainder of the cross wires are of heavier gauge, say 16 gauge on 2 inch centers, are extended outwardly beyond the bolster wires to form the cantilever supports for the bolster areas. The heavier cross wires may also permit elimination of some of the lighter cross wires, thereby effecting a further reduction of weight and cost. It has been found that in this manner, the weight of the cross wires required, and hence their cost, may be reduced by about 20%.

Another object is the provision of a spring base of the character described employing a novel means for connecting the cross wires to the bolster wires whereby said cross wires are held and maintained in properly spaced relation. Specifically, this is accomplished by providing each bolster wire with a molded sheath of plastic material having a radially projecting fin, the cross wires piercing said fin to be locked thereby against relative lateral movement.

A further object is the provision of a spring base of the character described which is well adapted for the application of pre-formed molded foam padding thereto, or to be permanently encapsulated by molding of said foam padding thereabout, in either case providing for easy attachment of the helical side support springs thereto, and for the attachment of decorative trim sheets applied over the padding.

Figure 2:
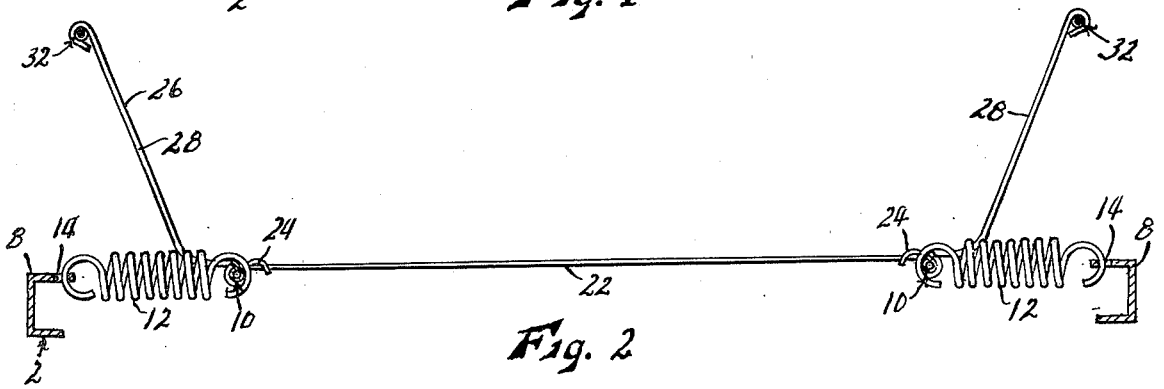
Figure 3:
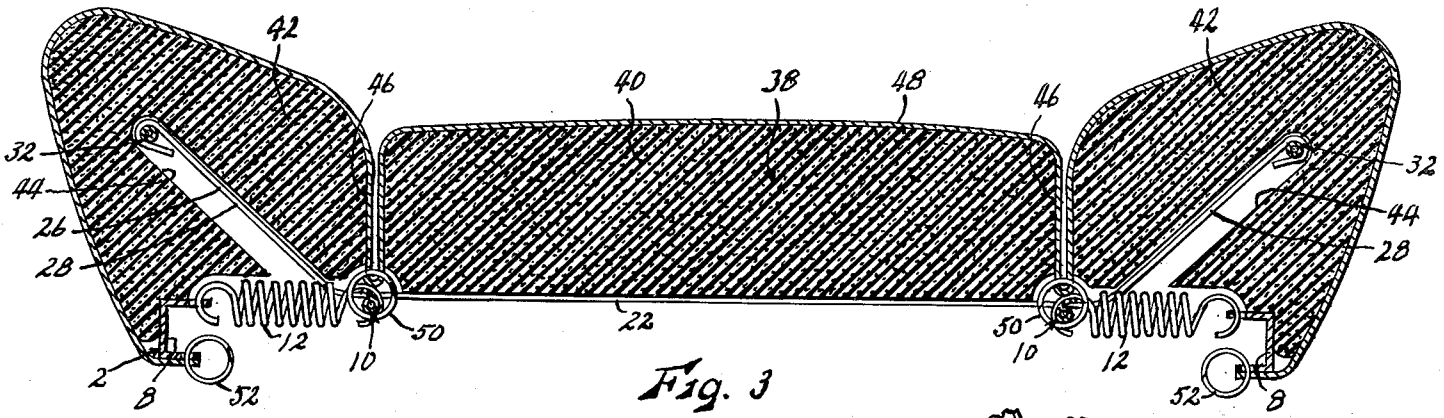
Figure 7:
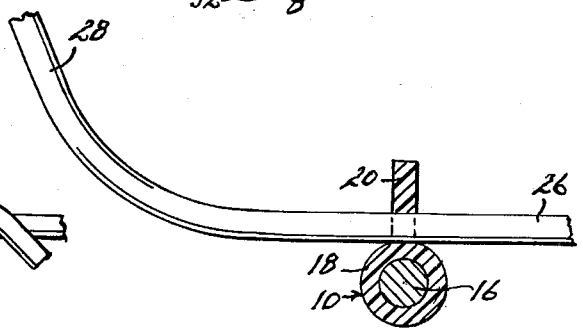
Figure 8:
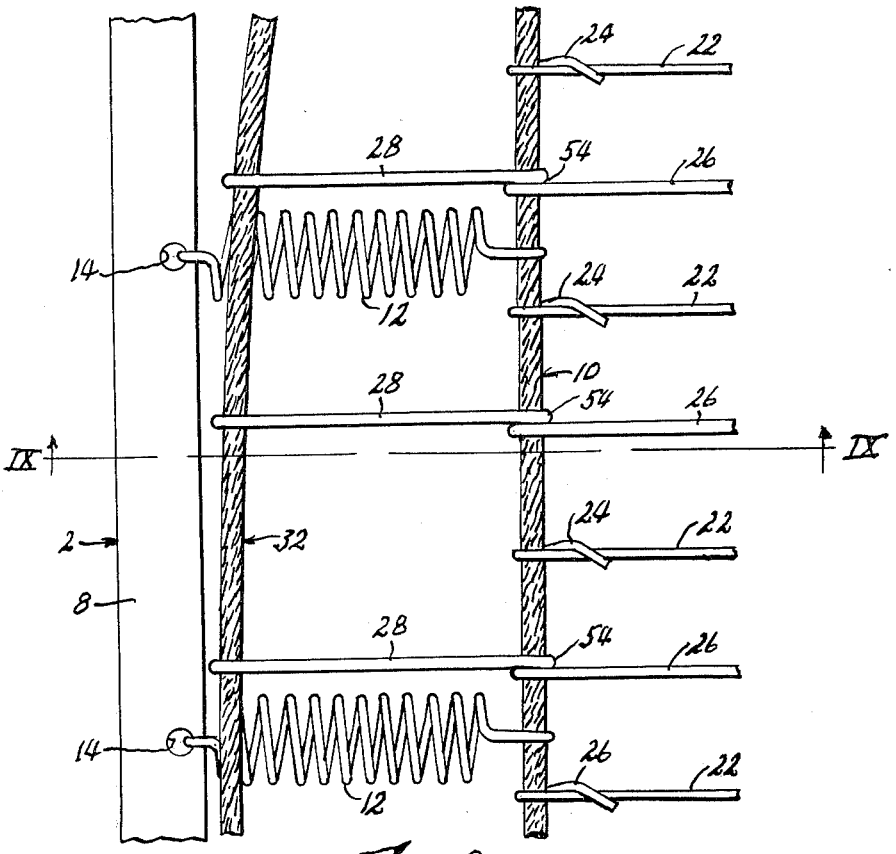
Figure 9:
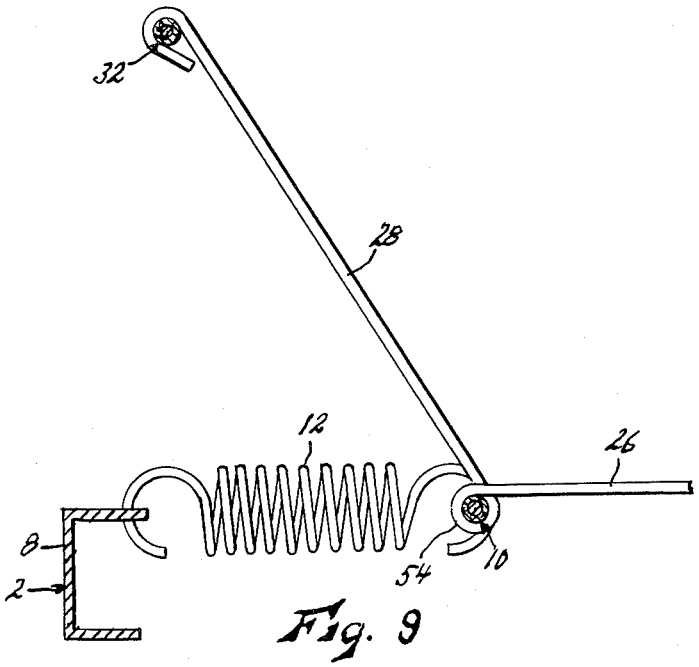

These as well as other objects will appear in the course of the specification, and with these in mind reference will be had to the accompanying drawings, wherein:

FIG. 1 is a top plan view of a spring base for upholstered seating embodying the present invention, shown operatively mounted in a rigid seat frame, FIG. 2 is a sectional view taken on line II—II of FIG. 1, FIG. 3 is a view similar to FIG. 2, but showing padding material and a trim sheet applied to the spring base, FIGS. 4, 5, 6 and 7 are enlarged, fragmentary sectional views taken respectively on lines IV—IV, V—V, VI—VI and VII—VII of FIG. 1, FIG. 8 is an enlarged, fragmentary view similar to FIG. 1, but showing a modification of structure, and FIG. 9 is a sectional view taken on line IX—IX of FIG. 8.

Figure 6:
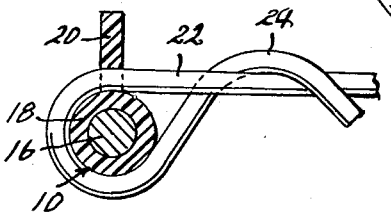
Figure 5:
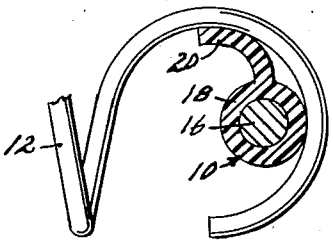

Like reference numerals apply to similar parts throughout the several views, and the numeral 2 applies to a generally rectangular rigid seat frame formed of channel iron having a C-shaped cross-sectional contour. Said frame is open, having a front rail 4, back rail 6, and side rails 8. The spring base includes a pair of bolster strands 10 extending forwardly and rearwardly of the seat, each in inwardly spaced relation from the associated frame side rail 8, and supported from said side rail by a series of spaced apart, laterally extending helical support springs 12, each of which is hooked at its inner end about the associated bolster strand 10 and at its outer end into a preforation 14 provided therefor in the top leg of the associated side rail 8 of the frame. In the version of the structure shown in FIGS. 1–7, each bolster strand 10 comprises a heavy spring wire core 16 having a sheath 18 of a plastic material such as certain types of polyolefins molded thereabout, as best shown in FIGS. 5–7. Said plastic is tough but flexible, and may be easily pierced by spring steel wires forced therethrough. The sheath is provided with a longitudinally continuous, radially extending fin 20 of the same material and integral therewith.

Figure 4:
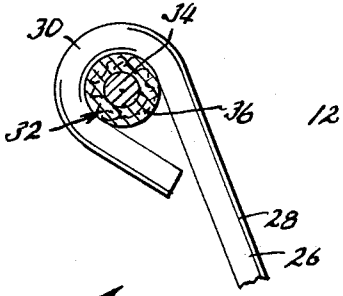

Bolster strands 10 are connected together by a series of closely spaced apart spring steel cross wires extending therebetween. Certain of said cross wires, designated at 22, are of relatively small gauge, and extend only between the bolster strands, each end of each wire piercing fin 20 of the bolster strand, then wrapped tightly about sheath 18, then bent, or "knotted", around its own standing portion, as indicated at 24 in FIG. 6. The remainder of the cross wires, designated at 26, are of a relatively heavy gauge as compared to wires 22. Wires 26 pierce fins 20 of the bolster strands, as indicated in FIG. 7, and are then inclined upwardly and outwardly, as indicated at 28, being twisted as indicated at 30 in FIG. 4 about a free forwardly and rearwardly extending margin strand 32. As also shown in FIG. 4, each margin strand 32 may consist of a spring wire core 34 having a sheath 36 of a soft, indentable material such as twisted paper or the like, so that forming the twist 30 of wire 26 thereabout will indent the sheath to prevent slippage of wires 26 along the margin wires.

FIG. 3 illustrates the application of pre-formed molded foam padding 38 to the spring base. Said padding may be of one-piece form, having a central portion 40 overlying the main seating area defined by the portions of wires 22 and 26 between bolster strands 10, and bolster portions 42 overlying and enclosing the inclined portions 28 of wires 26. Bolster portions 42 have preformed grooves 44 formed from the bottom thereof to receive wire portions 28 and margin strands 32 therein, and the bolster portions 42 are divided from central portion 40 by slots 46 arranged to coincide with bolster strands 10. A decorative trim sheet 48 may cover the foam padding, portions of said trim sheet being drawn down tightly into slots 46 and secured to bolster strands 10 by hog rings 50, while the edges of the trim sheet may be pulled snugly down around the edges of the padding and secured to the lower leg of frame 2 by hog rings 52. The bolster strands 10, cross wires 22 and 26, and margin strands 32 could also be permanently encapsulated by molding in the foam padding, so long as slots 46 were formed in the mold, and so long as any foam sections molded around bolster strands 10 were sufficiently thin to permit easy attachment of helical springs 12 and hog rings 50 thereto. The attachment of the trim sheet 48 to the frame by hog rings 52 may be utilized to pre-stress the bolster supporting portions 28 of wires 26 to any desired degree, as will be seen by a comparison of FIGS. 2 and 3.

Further explanation is deemed necessary to a full understanding of the invention. It has been found by long experience that a cross wire spacing of no more than about one inch is necessary in the main seating area, i.e. between the bolster wires, in order to prevent the padding from working down between the cross wires, since the unit loading in this area is relatively high. This may be called "continuity of padding support". It has also been found that if the cross wires are effectively affixed to the bolster wires at this one inch spacing, a bolster wire of about 12-gauge is about the maximum size which can be used which will withstand bending by the beam loading applied thereto in a one-inch span by the attachment of a helical spring 12 thereto between a pair of cross wires, while still permitting the seating surface to conform to the shape of body loads applied thereto in use, as required for comfort. In the bolster areas, however, the unit loading is much smaller, so that the cross wire spacing could be much wider so far as continuity of padding support is concerned, but these portions of the cross wires are subject to cantilever loading, rather than the principally tensile loading to which they are subjected in the main seating area, and therefore must be stiff enough to provide the proper degree "load strength". Therefore, in the previously common structure in which all of the cross wires were extended to underlie the bolster areas, a balancing of the requirement for continuity of padding support in the main seating area and load strength in the bolster areas required the use of about 17-gauge cross wires spaced on one-inch centers. Making the cross wires lighter between the bolsters would be permissable since these portions are loaded principally only in tension, in which they have ample strength, but they would not then provide sufficient load strength in the bolster areas. It has been found by experience that the typical bolster can be provided with both adequate continuity of padding support and adequate load strength by 16-gauge cross wires spaced on two-inch centers.

The present invention provides a substantial saving by making the cross wires 22 extending only between the bolsters 18 to 20-gauge instead of 17-gauge, and cross wires 26 extending to form the bolster supports 14 to 17-gauge. Wires 22 are spaced generally on one-inch centers, through certain of them may be eliminated, as shown, due to the presence of wires 26 to fill in the gaps. Wires 26 are spaced on two-inch centers. Their position relative to wires 22 are so related that the spacing between any two cross wires in the main seating area is in no case less than one inch, as required for continuity of padding support. Also, the point of attachment of each helical spring 12 to the bolster strands 0 is spanned by two cross wires 22 no more than one inch apart, in order that the bolster wire will be properly supported against the bending load applied thereto by the helical. Thus the main seating area is provided with adequate load strength and continuity of padding support, and the bolster areas are provided with the permissable decreased continuity of padding support and increased contilever load strength, at a substantial saving or wire weight and cost. 18-gauge wire, even on one-inch centers, could not provide the necessary load strength in the bolster areas. The weight of margin wires 34 is not particularly pertinent to the present invention, except that they should be heavier than wires 26. Actually, a spring base constructed according to this invention contains more cross wires (6 to 5) than one having continuous cross wires spaced on one-inch centers, but this difference is more than offset by the fact that the cross wires 22 are shorter and of reduced weight, while the full length cross wires 26 are fewer in number. It has been found that, using 18 and 16 gauge wire respectively for wires 22 and 26, the total cross wire weight has been reduced about 20% in the present structure, with no sacrifice of efficiency or durability. The reduction of weight is in itself extremely important to the automotive industry, in addition to which it provides a significant reduction in costs.

The connection of the cross wires to the bolster strands by piercing of the fin 20 of the sheath 18 of the latter provides a means for positively securing and maintaining the cross wires against slippage along the bolster wires, and hence maintaining them in properly spaced relation. As shown in FIGS. 1–7, wires 26 merely pierce said fin, and are not wrapped around the bolster strand as are wires 22. Hence they are free to some degree to slide longitudinally through said fin. This reduces the load capacity of wires 26 in the main seating area slightly, but any tendency for wires 26 to slip in fins 20 is largely offset by the fact that the bolster portions of these wires are embedded in padding material 38. Moreover, the straight-through relationship of wires 26 to fins 20 has the advantage that it eliminates the points of extreme stress concentration which would occur at the twist if said wires were twisted around the bolster strands. This stress concentration often results in eventual breakage of the wires, and is a common cause of failure in spring bases of this type. Also, the sheath 18 prevents grinding or rubbing "wire noises" which would otherwise occur at the connections of wires 26 to the bolster wires.

FIGS. 8 and 9 show a modified spring base structure similar in most respects to that shown in FIGS. 1–7 except that bolster strand 10 is provided with a twisted paper sheath in the same manner as margin strand 32, that cross wires 22 and 26 are alternated on one-inch centers, and that cross wires 26 are wrapped around bolster strands 10, as indicated at 54, before extending to margin strands 32, and are thus essentially fixed to said bolsters. This affixation permits helical springs 12 to be attached to the bolsters between any two successive cross wires, eliminating the necessity that they be attached only between two cross-wires 22 of one-inch spacing. It also permits the use of fewer cross wires, since each wire 26 may fully perform the functions of a wire 22, so that the one-inch spacing may be maintained between all of the cross wires, and thereby permits a further saving in wire weight. It does, however, possess the disadvantage that wires 26 are twisted around the bolsters at 54, which results in stress concentration and possible eventual breakage of the wires at these points, as referred to above.

While I have shown and described certain specific embodiments of my invention, it will be readily apparent that many minor changes of structure and operation could be made without departing from the spirit of the invention.

What I claim as new and desire to protect by Letters Patent is:

1. A spring base for the bottoms of upholstered seats of the type consisting generally of a generally level main seating area and upwardly and outwardly inclined bolster seating areas at the sides of said main seating area, and also suitable for use in the backs of said seats, said spring base comprising:

a. a pair of bolster strands each including a spring wire and extending forwardly and rearwardly of said seat respectively at opposite sides of said main seating area, b. a series of tension support springs connected at their inner ends to each of said bolster strands in spaced relation along said strand, and extending outwardly therefrom for connection at their outer ends to a rigid seat frame, and c. a series of spring steel cross wires extending transversely between said bolster strands to define said main seating area, a first group of said cross wires, spaced generally regularly along said bolster strands, being of relatively light-gauge wire, terminating and being affixed at their ends to said bolster wires, and being relatively closely spaced to supply an increased continuity of support for padding layers applied thereover, and a second group of said cross wires, also spaced generally regularly along said bolster strands, being connected to said bolster strands but extending outwardly therefrom in upwardly inclined relation to said main seating area to provide cantilever spring support for said bolster seating areas, the cross wires of said second group being of relatively heavy-gauge wire as compared to said first group, but being relatively widely spaced apart, whereby to provide the increased spring support but lesser continuity of padding support required in said bolster seating areas.

2. A spring base as recited in claim 1 for use when said padding material constitutes molded foam material, wherein the cross wire spacing in said main seating area is no more than about one inch between any pair of successive cross wires, and no more than about two inches in said bolster seating areas.

3. A spring base as recited in claim 2 wherein said first group of cross wires are formed of wire of about 18 to 20-gauge diameter, and said second group of cross wires are formed of wire of about 14 to 17-gauge diameter.

4. A spring base as recited in claim 1 wherein the connections of a successive pair of cross wires of said first group of cross wires to said bolster strands bridge each connection of each of said support springs to said bolster strands, said pair of cross wires being spaced sufficiently closely together to support said bolster wire against bending by the beam loading applied thereto by said support spring.

5. A spring base as recited in claim 4 wherein each of said bolster wires is of about 12-gauge diameter, and wherein the spacing of said pair of cross wires is no more than about one inch.

6. A spring base as recited in claim 1 wherein each of said bolster strands constitutes a spring steel wire having a sheath of soft indentable material, said sheath having a continuous, radially extending fin formed integrally therewith, each of said cross wires piercing said fin, whereby said cross wires are maintained in a predetermined distribution along said bolster strand.

7. A spring base as recited in claim 6 wherein the wires of said first group of cross wires, after piercing said fin, are twisted around said sheath and then around their own standing portions.

8. A spring base as recited in claim 7 wherein the wires of said second group of cross wires extend through said fin in straight piercing relationship thereto, and are then extended outwardly in upwardly inclined relation to form spring support for said bolster seating areas.

9. A spring base as recited in claim 1 wherein both of said groups of cross wires are effectively affixed to said bolster strands, but only the cross wires of said second group are extended to provide spring support for said bolster seating areas.

10. A spring base as recited in claim 9 wherein each of said bolster strands constitutes a spring wire having a soft, indentable sheath, and wherein each of the cross wires of both of said groups of cross wires is effectively affixed to each of said bolster strands by twisting thereof around the sheath of said bolster strand.

* * * * *